US005300855A

United States Patent [19]

Kweon

[11] Patent Number: 5,300,855

[45] Date of Patent: Apr. 5, 1994

[54] ELECTRON GUN FOR A COLOR CATHODE RAY TUBE

[75] Inventor: Yong-geol Kweon, Suwon, Rep. of Korea

[73] Assignee: Samsung Electron Devices Co., Ltd., Kyunggi, Rep. of Korea

[21] Appl. No.: 879,911

[22] Filed: May 8, 1992

[30] Foreign Application Priority Data

Nov. 26, 1991 [KR] Rep. of Korea ..... 91-21296
Nov. 26, 1991 [KR] Rep. of Korea ..... 91-21297

[51] Int. Cl.[5] ..... H01J 29/50

[52] U.S. Cl. ..... 313/414; 313/449; 313/412; 315/382

[58] Field of Search ..... 313/414, 412, 413, 425, 313/428, 432, 436, 439, 437, 447, 448, 460, 449; 315/14, 15, 382

[56] References Cited

U.S. PATENT DOCUMENTS

| | | | |
|---|---|---|---|
| 4,086,513 | 4/1978 | Evans, Jr. | 313/414 |
| 4,731,563 | 3/1988 | Bloom et al. | 313/414 X |
| 4,772,827 | 9/1988 | Osakabe | 313/414 X |
| 5,025,189 | 6/1991 | Son | 313/414 |
| 5,061,881 | 10/1991 | Suzuki et al. | 313/414 X |

*Primary Examiner*—Donald J. Yusko
*Assistant Examiner*—Ashok Patel
*Attorney, Agent, or Firm*—Leydig, Voit & Mayer

[57] ABSTRACT

An electron gun for a color cathode ray tube is formed such that parallel vertical blades are extending toward cathodes formed at both edges of each electron beam passing hole in the outgoing plate of a focus electrode. Horizontal blades extending toward the cathodes at a predetermined length are formed at the edges of the top and bottom portions of electron beam passing holes in the incoming plate of a dynamic focus electrode. Thus, the horizontal blades are inserted into the electron beam passing holes of the focus electrode, which reduces astigmatism due to deflection aberration and improves the focusing characteristics.

24 Claims, 5 Drawing Sheets

ELECTRON GUN FOR A COLOR CATHODE RAY TUBE

BACKGROUND OF THE INVENTION

The present invention relates to an electron gun for a color cathode ray tube, and, more particularly, to an electron gun for a color cathode ray tube, wherein the focusing characteristic of electron beams is improved by reducing astigmatism caused by an uneven magnetic field of a deflection yoke.

The resolution of a color cathode ray tube depends on the size of an electron beam which lands on a phosphor screen. Accordingly, in order to obtain a high resolution picture, it is important that the electron beam spot projected onto the phosphor screen is as small as possible without distortion or a halo. However, in conventional color cathode ray tubes, since the RGB electron guns are arranged in-line, and a deflection yoke is adopted which deflects magnetic field as a pincushion in the horizontal direction and as a barrel in the vertical direction, astigmatism of the electron beams emitted from the electron gun and landing on the phosphor screen, occur due to the uneven magnetic field of the deflection yoke.

When the electron beams produced from such an electron gun land on the center of the phosphor screen, the deflection magnetic field does not affect them, so astigmatism of the electron beams does not occur, thus enabling the formation of a circular electron beam spot without halo. However, when deflected toward the periphery of the phosphor screen, the electron beams diverge in the horizontal direction and are excessively focused in the vertical direction due to the deflection magnetic field. Therefore, the beam spot formed on the screen has a halo in the vertical direction around its bright core which is distorted in the horizontal direction, so that picture resolution is degraded.

One example of an electron gun for a conventional color cathode ray tube is illustrated in FIG. 1, which is devised to solve the above-described problem.

The conventional electron gun has a sequentially arranged triode consisting of cathodes 2, a control electrode 3, and a screen electrode 4, and a main lens system composed of a focus electrode 5, a dynamic focus electrode 6, and a final accelerating electrode 7. Vertically-elongated electron beam passing holes 5H are formed in focus electrode 5 to correspond to horizontally-elongated electron beam passing holes 6H in dynamic focus electrode 6. A predetermined static focus voltage Vf is supplied to focus electrode 5. An anode voltage Ve higher than focus voltage Vf is supplied to final accelerating electrode 7. A parabolic dynamic focus voltage Vfd is supplied to dynamic focus electrode 6, which is synchronized with the vertical/horizontal synchronizing signals of the deflection yoke and its negative peak is the same as focus voltage Vf.

In electron gun 1 of the conventional color cathode ray tube formed as described above, when the electron beams do not deflect, in other words, when the electron beams emitted from electron gun 1 land on the center of the phosphor screen, dynamic focus voltage Vfd whose negative peak voltage is the same as focus voltage Vf is supplied to dynamic focus electrode 6. Thus the potential of focus electrode 5 and dynamic focus electrode 6 is the same, so that a quadrupole lens is not formed between them. Therefore, the electron beams simply pass through a major lens formed between dynamic focus electrode 6 and final accelerating electrode 7, and then land on the center of the phosphor screen.

In contrast, when the electron beams emitted from cathodes 2 deflect toward the periphery of the phosphor screen due to the uneven deflection magnetic field, dynamic focus voltage Vfd synchronized with a deflection signal is applied to dynamic focus electrode 6, so that a quadrupole lens having a focusing lens in a focusing section and a diverging lens in a diverging section is formed between focus electrode 5 and dynamic focus electrode 6. Due to the vertically-elongated electron beam passing holes 5H formed in the outgoing plane of focus electrode 5 and the horizontally-elongated electron beam passing holes 6H formed in the incoming plane of dynamic focus electrode 6, the lens has a weaker focusing force and a stronger diverging force in the vertical direction relative to the horizontal direction. Therefore, the electron beams passing through the quadrupole lens having the two lenses are under the influence of a force which focuses in the horizontal direction and diverges in the vertical direction, so that the cross-sectional shape of the beams becomes vertically-elongated. When the vertically-elongated electron beam deflects toward the periphery of the phosphor screen after having passed through the major lens formed between dynamic focus electrode 6 and final accelerating electrode 7, the deflecting magnetic field of the deflection yoke compensates the distortion of the electron beam caused by the uneven deflecting magnetic field. That is, the electron beam diverges in the horizontal direction, and is focused in the vertical direction. As a result, a circular beam spot can be obtained at the periphery of the phosphor screen.

However, in electron gun 1 of the conventional color cathode ray tube, since vertically-elongated electron beam passing holes 5H are formed in the outgoing plane of focus electrode 5, and horizontally-elongated electron beam passing holes 6H are formed in the incoming plane of dynamic focus electrode 6, during assembly, it is difficult to make the vertically-elongated electron beam passing holes 5H accurately correspond to the horizontally-elongated electron beam passing holes 6H. Moreover, if vertically-elongated electron beam passing holes 5H do not exactly correspond to horizontally-elongated electron beam passing holes 6H, the quadrupole lens formed between beam passing holes 5H and 6H becomes asymmetric which abnormally distorts the electron beams passing through the lens so that a desirable electron beam spot cannot be obtained To be specific, focus electrode 5 and dynamic focus electrode 6 which form the quadrupole lens are spaced apart from each other by a predetermined interval. For this reason, since an external electric field, i.e., an electric field flowing inside the neck, possibly encroaches between focus electrode 5 and dynamic focus electrode 6, the static lens may be distorted by leakage of the electric field.

SUMMARY OF THE INVENTION

The present invention is designed to solve the above-described problems

Accordingly, it is the object of the present invention to provide an electron gun for a color cathode ray tube, wherein astigmatism of electron beams caused by an uneven magnetic field of a deflection yoke is compensated for (or reduced), which forms a beam spot of good quality whose halo is minimized throughout a phosphor screen, thereby improving the resolution of a picture.

To achieve the above and other objects of the present invention, there is provided an electron gun for a color cathode ray tube comprising:

a triode including cathodes, a control electrode and a screen electrode; and a main lens system having an auxiliary lens and a major lens including a focus electrode supplied with a focus voltage, a dynamic focus electrode supplied with a dynamic focus voltage, and a final accelerating electrode supplied with an anode voltage, wherein vertical blades parallel with one another in the vertical direction are formed at both edges of the horizontal direction of electron beam passing holes formed in an outgoing plane of the focus electrode, and are arranged toward the cathodes, and horizontal blades parallel with one another in the horizontal direction are formed at the edges of the upper and lower portions of electron beam passing holes formed in an incoming plane of the dynamic focus electrode, and protrude into the electron beam passing holes.

Preferably, the horizontal width of the vertical blade of the focus electrode is the same as the diameter of the electron beam passing hole in the dynamic focus electrode.

BRIEF DESCRIPTION OF THE DRAWINGS

These and other objects, features, aspects and advantages of the present invention will become more apparent from the following detailed description of the present invention when taken in conjunction with the accompanying drawings, in which.

DETAILED DESCRIPTION OF THE INVENTION

Figure 1:
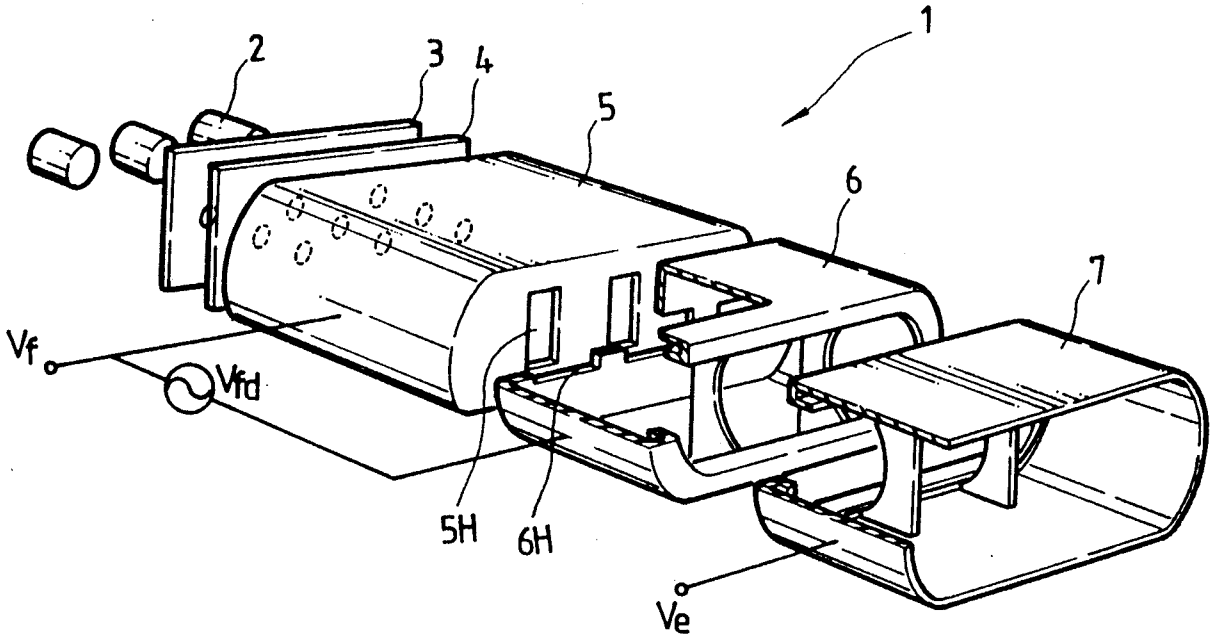
FIG. 1 (PRIOR ART)
FIG. 1 is a partially cutaway perspective view of an electron gun for a conventional color cathode ray tube.
Figure 2:
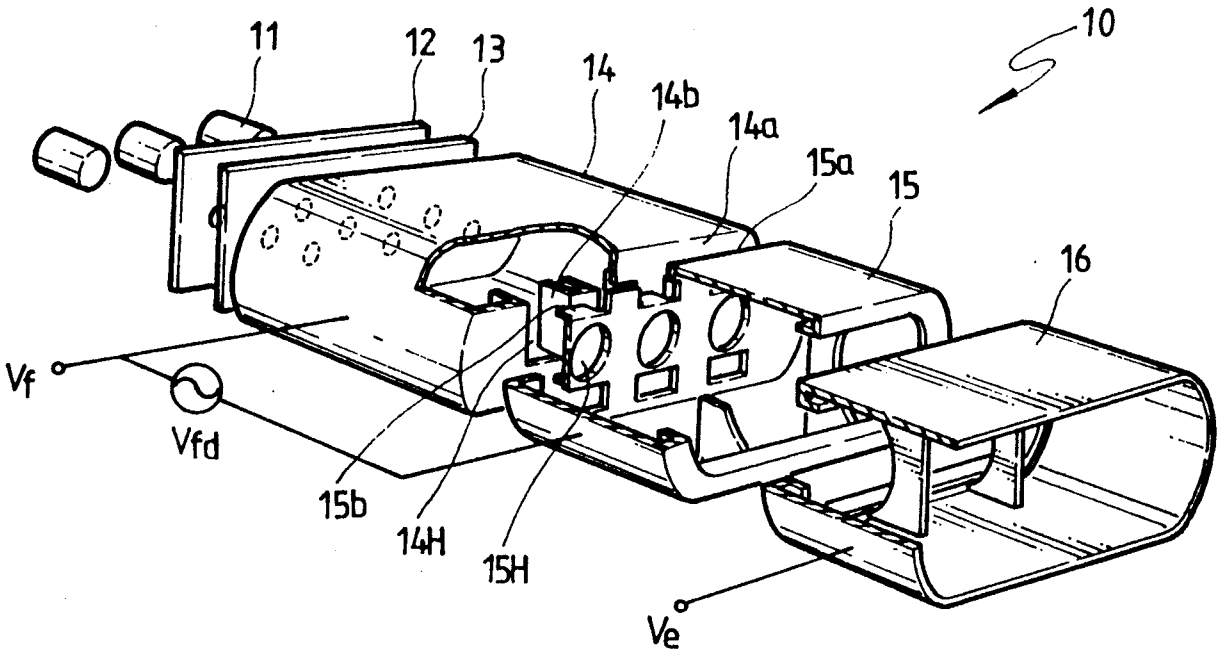
FIG. 2 is a partially cutaway perspective view of an electron gun for a color cathode ray tube according to the present invention.

An electron gun 10 for a color cathode ray tube according to the present invention illustrated in FIG. 2, has a sequentially arranged preceding triode consisting of cathodes 11, a control electrode 12 and a screen electrode 13, and a main lens system having an auxiliary lens and a major lens, which includes a focus electrode 14, a dynamic focus electrode 15 and a final accelerating electrode 16.

Figure 3:
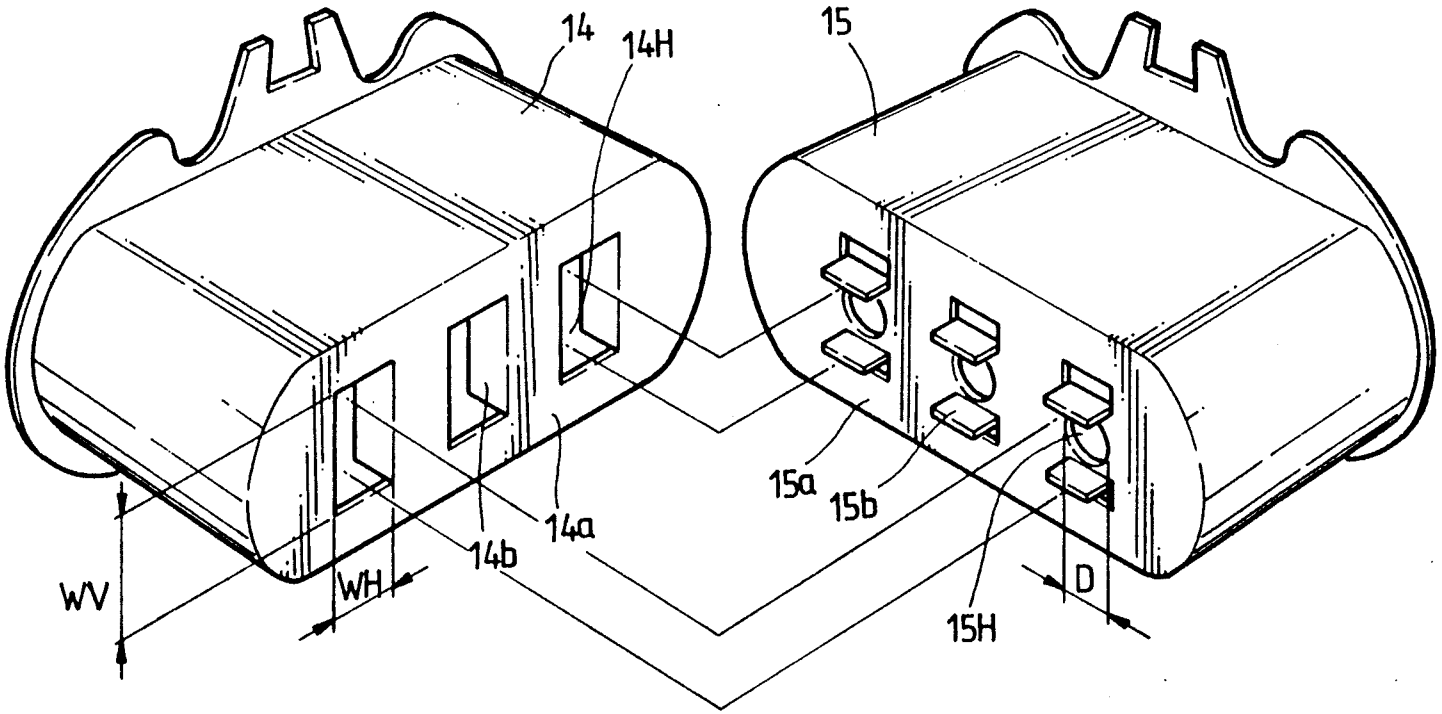
FIG. 3 is a perspective view of the focus electrode and the dynamic focus electrode extracted from the electron gun shown in FIG. 2.

As illustrated in FIG. 3, vertical blades **14*b* are arranged toward cathodes 11, which are parallel along both edges of electron beam passing holes 14H formed in outgoing plane 14*a* of focus electrode 14. Also, horizontal blades 15*b* of a predetermined length and extending toward cathodes 11 are formed at the edges of the top and bottom portions of electron beam passing holes 15H formed in incoming plane 15*a* of dynamic focus electrode 15. Horizontal blades 15*b* of dynamic focus electrode 15 enter into electron beam passing holes 14H formed in outgoing plane 14*a* of focus electrode 14, thereby forming a substantial quadrupole lens portion surrounding the electron beam path together with vertical blades 14*b* of focus electrode 14. Here, it is desirable that vertical blade 14*b* formed in outgoing plane 14*a* of focus electrode 14 is formed by a pressing process of outgoing plane 14*a* of focus electrode 14. Likewise, horizontal blade 15*b* formed in incoming plane 15*a* of focus electrode 15 is formed by a pressing process of incoming plane 15*a* of dynamic focus electrode 15. Thus, each blade is integrally formed with each electrode. Electron beam passing hole 14H formed in outgoing plane 14*a* of focus electrode 14 is a vertically elongated rectangle, in which the vertical width WV is larger than the horizontal width WH. The horizontal width WH of the vertically-elongated rectangle hole is identical to the diameter D of electron beam passing hole 15H formed in incoming plane 15*a* of dynamic focus electrode 15**.

Figure 4:
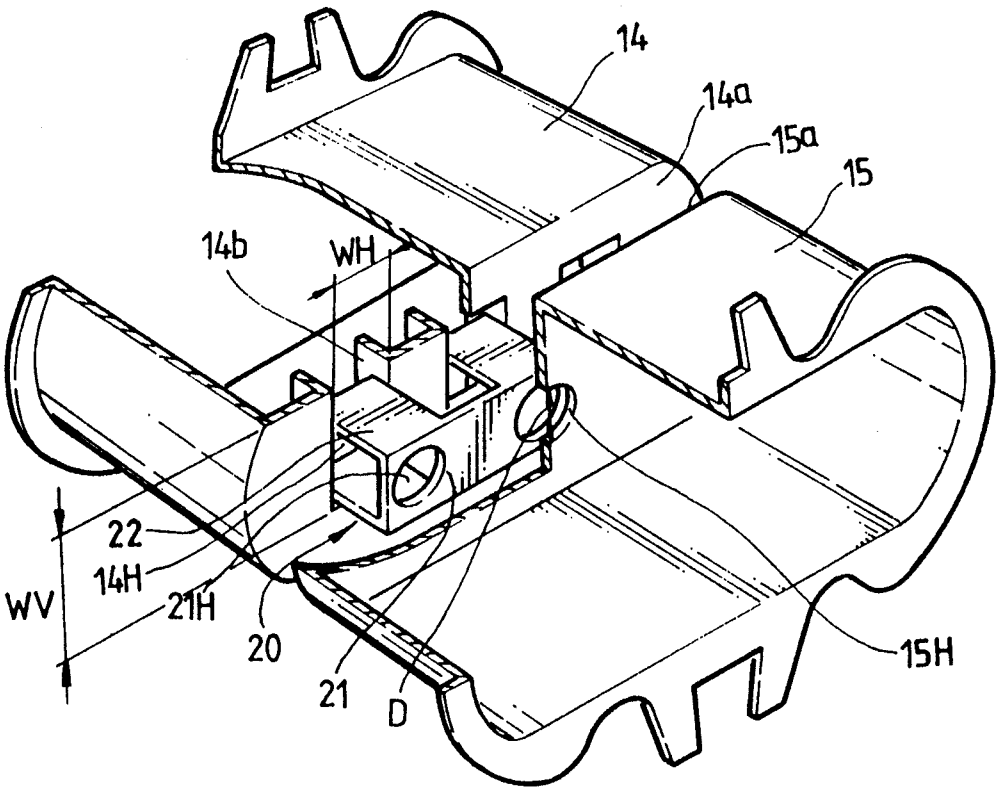
FIG. 4 is a partially cutaway perspective view showing another embodiment of the focus electrode and dynamic focus electrode of the electron gun shown in FIG. 2.
Figure 5:
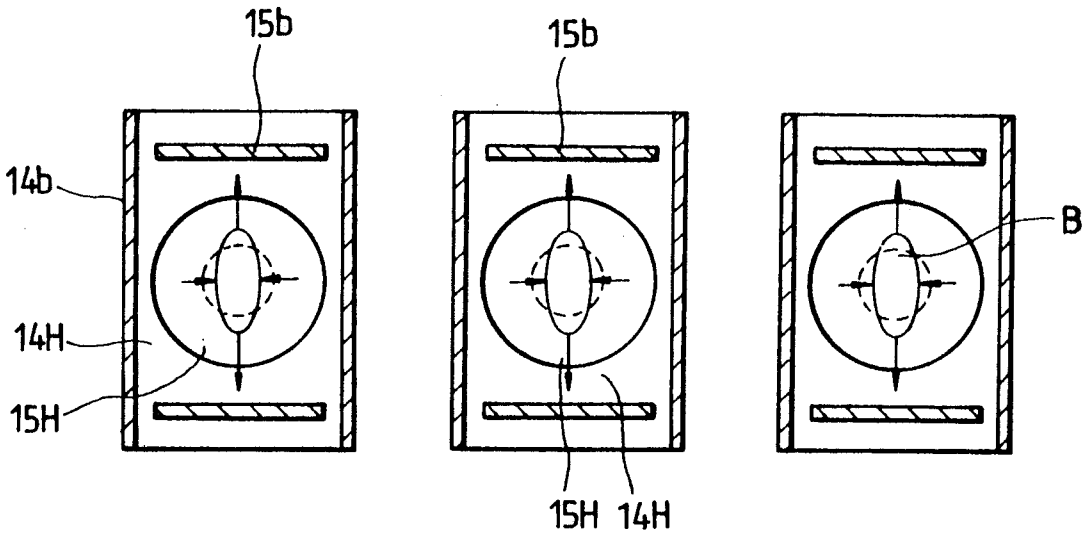
FIG. 5 is a view visualizing three electron beams under the influence of the vertical blades and horizontal blades of the electron gun shown in FIG. 2.

In another of the invention of focus electrode 14 and dynamic focus electrode 15 illustrated in FIG. 4, an auxiliary electrode segment 20 with a horizontal blade 22 is attached in incoming plane **15*a* of dynamic focus electrode 15. Auxiliary electrode segment 20 is composed of a plate-type body 21 having electron beam passing holes 21H which corresponds to, and are the same size as, electron beam passing holes 15H in dynamic focus electrode 15. Horizontal blades 22 are inserted into electron beam passing holes 14H of focus electrode 14, extending toward cathodes 11 at the edges of top and bottom portions of the electron beam passing holes 21H formed in body 21. Preferably, the horizontal blades 22 are integrally formed with the body 21**, and, in certain circumstances, may be formed by attaching a separately produced member.

The electrodes constituting electron gun 10 are respectively supplied with predetermined voltages. Focus electrode 14 is supplied with a predetermined focus voltage Vf, dynamic focus electrode 15 is supplied with a dynamic focus voltage Vfd which is synchronized with a deflection signal and its negative peak voltage is focus voltage Vf, and final accelerating electrode 16 is supplied with an anode voltage Ve which is the highest voltage.

The operation of the above-described electron gun for the cathode ray tube according to the present invention is as follows.

In electron gun 10 when predetermined voltages are supplied to respective electrodes, a prefocusing lens is formed between screen electrode 13 and focus electrode 14. Also, a dynamic quadrupole lens is formed between focus electrode 14 and dynamic focus electrode 15 by dynamic focus voltage Vfd. Additionally, a major lens is formed between dynamic focus electrode 15 and final accelerating electrode 16.

Thermoelectrons are emitted from respective cathodes 11, and the emitted thermoelectrons are transformed to initial beams by the control electrode 12 and screen electrode 13. The initially generated beams are accelerated and focused while passing through the lenses formed between respective electrodes, and then land on the phosphor screen. At this time, the controlling of the electron beams is presented as below, classified into two states: scanning on the center and on the periphery.

First, when the electron beams emitted from cathodes 11 are scanning on the center of the phosphor screen, the lowest dynamic focus voltage Vfd which is synchronized with the deflection signal is applied to dynamic focus electrode 15. Thus, equipotential focus voltage Vf is applied to focus electrode 14 and dynamic focus electrode 15. Accordingly, a quadrupole lens whose focusing force differs in the horizontal and vertical directions is not formed between focus electrode 14 and dynamic focus electrode 15, so that the electron beams emitted from cathodes 11 pass through the prefocusing lens, and then pass through the center of the major lens formed between dynamic focus electrode 15 and final accelerating electrode 16, thereby landing on the center of the phosphor screen in the optimum condition.

When the electron beams emitted from cathodes 11 are deflected toward the periphery of the phosphor screen by the deflection yoke, dynamic focus voltage Vfd synchronized with the deflection signal is supplied to dynamic focus electrode 15. Thus, the quadrupole lens is formed between focus electrode 14 and dynamic focus electrode 15, i.e., within a space sectioned by vertical blade **14*b* and horizontal blade 15*b* or 22. As a result, the electron beams emitted from cathodes 11** are vertically-elongated after having passed through the prefocusing lens and quadrupole lens, and finally focused and accelerated while passing through the major lens, and then scanned along the periphery of the phosphor screen being deflected by the deflection yoke. Here, the vertically-elongated electron beams are distorted by the uneven magnetic field while being deflected by the deflection yoke, thereby enabling the electron beam spot landing on the phosphor screen to be circular.

In keeping with the invention quadrupole lens formed within the space sectioned by vertical blade **14*b* supplied with focus voltage Vf and horizontal blade 15*b* or 22 supplied with dynamic focus voltage Vfd, whose lowest voltage is focus voltage Vf, has a weaker focusing force and a stronger diverging force in the vertical direction than in the horizontal direction. Conversely stated, the lens has a stronger focusing force and weaker diverging force in the horizontal direction than in the vertical direction. Therefore, the electron beams passing through the lens are under the influence of a force which strongly diverges in the vertical direction and focuses in the horizontal direction. Accordingly the cross-sectional shape of the beams becomes vertically-elongated. When the vertically-elongated electron beam deflects toward the periphery of the phosphor screen, the distortion of the electron beams caused by the non-uniform magnetic field of the deflection yoke is compensated for, i.e., the beams diverge in the horizontal direction and focus in the vertical direction. As a result, a circular beam spot can be obtained at the periphery of the phosphor screen. Also, since focus voltage Vf which is the lowest voltage and dynamic focus voltage Vfd are supplied to dynamic focus electrode 15, the potential difference between the voltages supplied to dynamic focus electrode 15 and final accelerating electrode 16** is decreased. Consequently, the intensity of the major lens becomes weak, and the focal distance is lengthened, which enables optimum focusing to be obtained when the electron beams deflect toward the periphery of the phosphor screen.

When assembling an electron gun 10 of the present invention, since the horizontal width WH of electron beam passing hole 14H formed in focus electrode 14 is the same as the diameter D of electron beam passing hole 15H in incoming plane **15*a* of dynamic focus electrode 15, their positions are set while being inserted into the electrode supporting rod of the assembling fixture, thereby being capable of improving the precision of assembly as compared with a conventional electron gun. Further, although focus electrode 14 is somewhat deflected toward vertical direction from the arranged direction of the electrodes, the length of vertical blade 14*b* of focus electrode 14, i.e., vertical width WV of electron beam passing hole 14H, is longer than the spacing between horizontal blades 15*b* or 22 of dynamic focus electrode 15. Hence the formation of the quadrupole lens is not affected by the vertical deflection of focus electrode 14**, which in turn widens the maximum allowable margin of error during assembly.

As described above, in the electron gun for a color cathode ray tube according to the present invention, the quadrupole lens is formed within a space sectioned by vertical and horizontal blades of the focus electrode and dynamic focus electrode while deflecting electron beams by a deflection yoke. Therefore, the quadrupole lens effect can be enhanced. Furthermore, abnormal distortion of the electron beams caused by the uneven magnetic field of the deflection yoke is compensated, and astigmatism is also decreased in the cathode ray tube adopting the electron gun. As a result, picture resolution can be improved.

What is claimed is:

1. An electron gun for a color cathode ray tube comprising:

a triode;

a focus electrode having a first plane and a second plane, the second plane including a plurality of electron beam passing holes;

parallel vertical blades formed along the perimeter of the electron beam passing holes of said focus electrode extending towards said triode;

a dynamic focus electrode having a first plane and a second plane, the first plane including a plurality of electron beam passing holes;

parallel horizontal blades formed along the perimeter of the electron beam passing holes of the first plane of said dynamic focus electrode, said parallel horizontal blades protruding into the electron beam passing holes of the second plane of said focus electrode; and a final accelerating electrode.

2. An electron gun for the color cathode ray tube as claimed in claim 1, wherein said vertical blades on said focus electrode are integrally formed with said focus electrode, and said horizontal blades on said dynamic focus electrode are integrally formed with said dynamic electrode.

3. An electron gun for the color cathode ray tube as claimed in claim 1, wherein each of the electron beam passing holes formed in said second plane of said focus electrode includes a vertical dimension and a horizontal dimension, the vertical dimension being greater than the horizontal dimension.

4. An electron gun for the color cathode ray tube as claimed in claim 3, wherein the electron beam passing holes formed in the second plane of said focus electrode are vertically-elongated rectangular holes and the electron beam passing holes of the first plane of said dynamic focusing electrode are circular holes each circular hole having an identical diameter.

5. An electron gun for the color cathode ray tube as claimed in claim 4, wherein the horizontal dimension of the electron-beam passing hole in the second plane of said focus electrode is the same as the diameter of the electron beam passing holes of the first plane of said dynamic focus electrode.

6. An electron gun for the color cathode ray tube as claimed in claim 1, further comprising means for supplying voltage to said focus electrode, said dynamic focus electrode and said final accelerating electrode.

7. An electron gun for the color cathode ray tube as claimed in claim 1 wherein said dynamic focus electrode is supplied with a greater voltage than said focus electrode.

8. An electron gun for the color cathode tube as claimed in claim 1 wherein said final accelerating electrode is supplied with a greater voltage than said dynamic focus electrode.

9. An electron gun for a color cathode ray tube comprising:

a triode;

a focus electrode having and a second plane, the second plane including a plurality of electron beam passing holes each having identical vertical dimensions and identical horizontal dimensions;

parallel vertical blades formed along the perimeters of each electron beam passing hole of said second plane of said focus electrode extending towards said triode;

a dynamic focus electrode having a first plane and a second plane, the first plane including a plurality of circular electron beam passing holes each having a diameter that is smaller than the vertical dimension of the electron beam passing holes of said focus electrode;

parallel horizontal blades integrally formed along the perimeters of each electron beam passing hole of said dynamic focus electrode, said parallel horizontal blades protruding into the electron beam passing holes of the outgoing plate of said focus electrode; and a final accelerating electrode.

10. An electron gun for the color cathode ray tube as claimed in claim 9 wherein said vertical blades on said focus electrode are integrally formed with said focus electrode.

11. An electron gun for the color cathode ray tube as claimed in claim 9, wherein the vertical dimension of the electron beam passing holes formed in the second plane of said focus electrode is greater than the horizontal dimension of the electron beam passing holes formed in the second plane of said focus electrode.

12. An electron gun for the color cathode tube as claimed in claim 11, wherein the electron beam passing holes formed in the second plane of said focus electrode are vertically-elongated rectangular holes.

13. An electron gun for the color cathode ray tube as claimed in claim 9 wherein the horizontal dimension of the electron beam passing holes in the second plane of said focus electrode is equal to a diameter of the electron beam passing holes in the first plate of said dynamic focus electrode.

14. An electron gun for the color cathode ray tube as claimed in claim 9, further comprising means for supplying voltage to said focus electrode, said dynamic focus electrode and said final accelerating electrode.

15. An electron gun for the color cathode ray tube as claimed in claim 9 wherein said dynamic focus electrode is supplied with a greater voltage than said focus electrode.

16. An electron gun for the color cathode tube as claimed in claim 9 wherein said final accelerating electrode is supplied with a greater voltage than said dynamic focus electrode.

17. An electron gun for a color cathode ray tube comprising:

a triode;

a focus electrode having a first plane and a second plane, the second plane including a plurality of electron beam passing holes;

parallel vertical blades formed along the perimeters of each of the plurality of electron beam passing holes, said parallel vertical blades extending towards said triode;

a dynamic focus electrode having a first plane and a second plane, the first plane including a plurality of circular electron beam passing holes;

an auxiliary electrode disposed between said focusing electrode and said dynamic focusing electrode, said auxiliary having a plurality of circular electron beam passing holes which correspond in shape and dimension to the electron beam passing holes of the first plane of said dynamic focus electrode;

parallel horizontal blades integrally formed along the perimeters of each of the electron beam passing holes of said auxiliary electrode, said parallel horizontal blades protruding into the electron beam passing holes of the second plane of said focus electrode; and a final accelerating electrode.

18. An electron gun for the color cathode ray tube as claimed in claim 17 wherein said vertical blades on said focus electrode are integrally formed with said focus electrode.

19. An electron gun for the color cathode ray tube as claimed in claim 17, wherein each electron beam passing hole of the second plane of said focus electrode has a vertical dimension and a horizontal dimension, each electron beam passing hole having the same vertical dimension and horizontal dimension, the vertical dimension being greater than the horizontal diameter.

20. An electron gun for the color cathode tube as claimed in claim 19, wherein the electron beam passing holes formed in the second plane of said focus electrode are vertically-elongated rectangular holes.

21. An electron gun for the color cathode ray tube as claimed in claim 17 wherein the electron beam passing holes in the first plane of said dynamic focus electrode have a common diameter and the horizontal dimension of the electron beam passing holes in the second plane of said focus electrode is equal to the diameter of the electron beam passing holes in the first plane of said dynamic focus electrode.

22. An electrode gun for the color cathode ray tube as claimed in claim 17, further comprising means for supplying voltage to said focus electrode, said dynamic focus electrode and said final accelerating electrode.

23. An electron gun for the color cathode ray tube as claimed in claim 17 wherein said dynamic focus electrode is supplied with a greater voltage than said focus electrode.

24. An electron gun for the color cathode tube as claimed in claim 17 wherein said final accelerating electrode is supplied with a greater voltage than said dynamic focus electrode.

* * * * *

UNITED STATES PATENT AND TRADEMARK OFFICE

CERTIFICATE OF CORRECTION

PATENT NO. : 5,300,855

DATED : April 5, 1994

INVENTOR(S) : Kweon

It is certified that error appears in the above-indentified patent and that said Letters Patent is hereby corrected as shown below:

Column 7, line 13, after "cathode" insert --ray--;

Column 7, line 20, after "having" insert --a first plane--;

Column 7, line 52, after "cathode" insert --ray--;

Column 8, line 3, after "cathode" insert --ray--;

Column 8, line 44, after "cathode" insert --ray--;

Column 8, line 64, after "cathode" insert --ray--.

Signed and Sealed this

Twentieth Day of September, 1994

*Attest:*

*Attesting Officer*

Bruce Lehman

BRUCE LEHMAN

*Commissioner of Patents and Trademarks*